US012594974B2

(12) United States Patent
Puramana et al.

(10) Patent No.: US 12,594,974 B2
(45) Date of Patent: Apr. 7, 2026

(54) MULTI-CARRIAGE VEHICLE BOARDING RECOMMENDATIONS

(71) Applicant: DISH Network Technologies India Private Limited, Bangalore (IN)

(72) Inventors: Dileep Puramana, Malappuram (IN); Vikram Balarajashetty, Bangalore (IN); Visali Manoharan, Chennai (IN); K. B. Sendhil Kumar, Bangalore (IN)

(73) Assignee: DISH Network Technologies India Private Limited, Karnataka (IN)

( * ) Notice: Subject to any disclaimer, the term of this patent is extended or adjusted under 35 U.S.C. 154(b) by 96 days.

(21) Appl. No.: 18/397,270

(22) Filed: Dec. 27, 2023

(65) Prior Publication Data

US 2025/0214632 A1 Jul. 3, 2025

(51) Int. Cl.
*B61D 41/04* (2006.01)
*B61L 15/00* (2006.01)

(52) U.S. Cl.
CPC ..... *B61D 41/04* (2013.01); *B61L 15/0072* (2013.01); *B61L 15/009* (2013.01)

(58) Field of Classification Search
CPC .... B61D 41/04; B61L 15/0072; B61L 15/009
See application file for complete search history.

(56) References Cited

U.S. PATENT DOCUMENTS

| | | | | |
|---|---|---|---|---|
| 11,474,519 | B2 * | 10/2022 | Hicok | G05D 1/249 |
| 2016/0355199 | A1 * | 12/2016 | Kernwein | B61L 15/0027 |
| 2017/0066458 | A1 * | 3/2017 | Huchrowski | B61L 15/0063 |
| 2017/0106884 | A1 * | 4/2017 | Oswald | B61L 15/0062 |
| 2018/0096599 | A1 * | 4/2018 | Nagao | B61L 27/57 |
| 2020/0055532 | A1 * | 2/2020 | Schultz | B61L 15/0062 |
| 2020/0167697 | A1 * | 5/2020 | Tran | G06Q 10/02 |
| 2020/0208465 | A1 * | 7/2020 | Ueda | B61L 15/009 |
| 2023/0245461 | A1 * | 8/2023 | Seko | G06V 40/168 382/103 |

FOREIGN PATENT DOCUMENTS

| | | | | |
|---|---|---|---|---|
| CN | 106779194 | | 5/2017 | |
| EP | 2975561 | | 1/2016 | |
| JP | 2019123581 | A * | 7/2019 | |
| WO | WO-2014049720 | A1 * | 4/2014 | G01C 21/3655 |
| WO | WO-2014054136 | A1 * | 4/2014 | G01C 21/3632 |
| WO | WO 2016092687 | | 6/2016 | |

* cited by examiner

*Primary Examiner* — Joseph J Dallo
(74) *Attorney, Agent, or Firm* — Fish & Richardson P.C.

(57) ABSTRACT

Methods, systems, and apparatus, including computer programs encoded on computer storage media, for generating and presenting the boarding guides to assist passengers with boarding a multi-carriage vehicle. One of the methods includes receiving, at one or more computing devices, information indicative of occupancy of a plurality of carriages of a multi-carriage vehicle, wherein the information is based on data captured using one or more sensors deployed within the multi-carriage vehicle; for each of the plurality of carriages, determining, based on processing the received information, an estimated number of additional passengers the corresponding carriage can accommodate; generating, based on the corresponding estimated numbers of additional passengers for each of the plurality of carriages, a boarding guide for the multi-carriage vehicle; and providing the boarding guide for presentation on a display device configured to assist with boarding passengers on the multi-carriage vehicle.

20 Claims, 4 Drawing Sheets

MULTI-CARRIAGE VEHICLE BOARDING RECOMMENDATIONS

BACKGROUND

This specification generally relates to computer systems and, in particular, relates to systems for handling passenger distribution for multi-carriage vehicles. Examples of multi-carriage vehicles include trains, subway trains, trolleys, and trams.

SUMMARY

In general, one innovative aspect of the subject matter described in this specification can be embodied in a method that includes: receiving, at one or more computing devices, information indicative of occupancy of a plurality of carriages of a multi-carriage vehicle, wherein the information is based on data captured using one or more sensors deployed within the multi-carriage vehicle; for each of the plurality of carriages, determining, based on processing the received information, an estimated number of additional passengers the corresponding carriage can accommodate; generating, based on the corresponding estimated numbers of additional passengers for each of the plurality of carriages, a boarding guide for the multi-carriage vehicle; and providing the boarding guide for presentation on a display device configured to assist with boarding passengers on the multi-carriage vehicle.

Other embodiments of these aspects include corresponding computer systems, apparatus, computer program products, and computer programs recorded on one or more computer storage devices, each configured to perform the actions of the methods. A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

The foregoing and other embodiments can each optionally include one or more of the following features, alone or in combination. In particular, one embodiment includes all the following features in combination.

In some implementations, the one or more sensors deployed within the multi-carriage vehicle may comprise one or more of: a millimeter-wave (mmWave) sensor, an ultra-wide band (UWB) sensor, a thermal sensor, a pressure sensor, or an optical sensor. In some implementations, the one or more sensors deployed within the multi-carriage vehicle may comprise one or more image sensors. In some implementations, determining the estimated number of additional passengers the corresponding carriage can accommodate may comprise: determining an estimated number of onboard passengers who will exit the carriage at a next stop of the multi-carriage vehicle. In some implementations, the display device may comprise a display device located in a platform at the next stop. In some implementations, the display device may comprise a display device of a mobile computing device. In some implementations, the display device may comprise an audio display device.

This specification uses the term "configured to" in connection with systems, apparatus, and computer program components. That a system of one or more computers is configured to perform particular operations or actions means that the system has installed on it software, firmware, hardware, or a combination of them that in operation cause the system to perform those operations or actions. That one or more computer programs is configured to perform particular operations or actions means that the one or more programs include instructions that, when executed by data processing apparatus, cause the apparatus to perform those operations or actions. That special-purpose logic circuitry is configured to perform particular operations or actions means that the circuitry has electronic logic that performs those operations or actions.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This document describes technology that allows for managing crowd distribution by generating and presenting the boarding guides to assist passengers with boarding a multi-carriage vehicle such as a train. The boarding guides are generated based on processing sensor data captured by one or more different types of sensors within or about an environment that includes the multi-carriage vehicle. The sensors include one or more of: image sensors, e.g., still cameras or video cameras, millimeter-wave (mmWave) sensors, ultra-wide band (UWB) sensors, thermal sensors, pressure sensors, optical sensors, and other types of sensors.

Using a multi-carriage vehicle may involve waiting for the vehicle at a waiting area with multiple passengers and riding onboard the vehicle with multiple passengers. Passengers may self-distribute according to their needs while waiting. During the periods where the multi-carriage vehicle supports high passenger traffic, the self-distribution of a large number of passengers in the waiting areas for vehicle carriages may contribute to uneven and inefficient distributions of passengers in the vehicle carriages once they are onboard. Furthermore, during these periods, crowding may make it challenging for passengers to find a carriage that accommodates the passengers' needs. Inefficient boarding of carriages may lead to an unpleasant experience for passengers, and potentially to unwanted delays.

The technology described herein can address the issues described above by generating and presenting the boarding guides based on real-time sensor data to assist passengers with boarding a multi-carriage vehicle. The boarding guides include information about the estimated available capacity, e.g., the amount of available passenger space, in each of multiple carriages of the vehicle. The boarding guides can be presented in a way that is easily accessible to all passengers awaiting the multi-carriage vehicle. When presented to passengers in the waiting area for the vehicle before the vehicle arrives, the boarding guides facilitate passenger distribution for efficient use of multi-carriage vehicles.

The presentation of the boarding guides can facilitate efficient boarding of carriages, improve the experience of traveling on multi-carriage vehicles, and improve the overall operating efficiency of multi-carriage vehicles (because vehicle schedule delays caused by inefficient boarding of carriages are reduced). For example, the presentation of the boarding guides, which indicate a full or near-full capacity in a particular carriage may encourage passengers awaiting the multi-carriage vehicle to avoid an overly crowded carriage where the amount of available passenger space is limited by self-distributing to queue for and board the other carriages of the vehicle.

Figure 1:
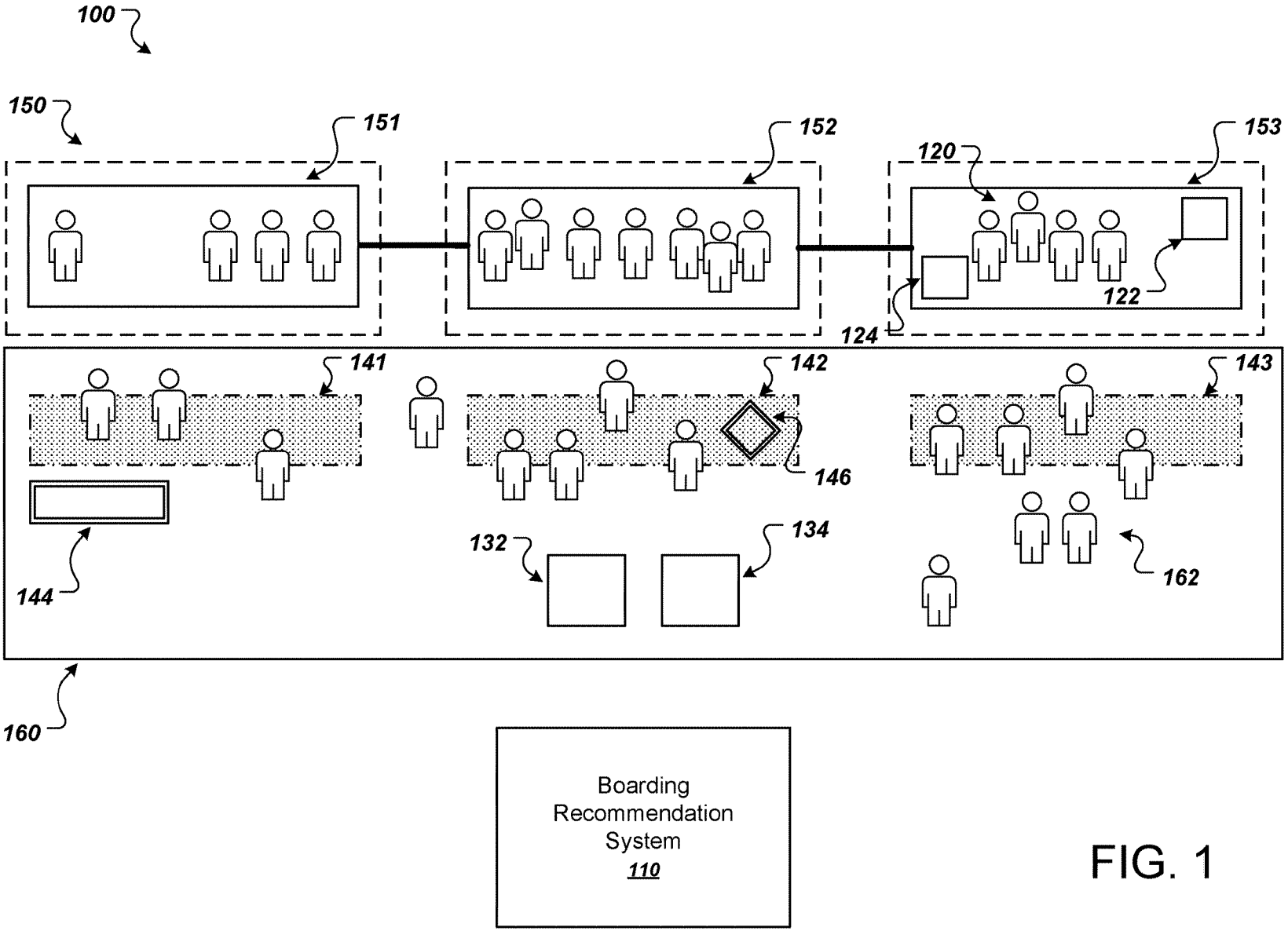
FIG. 1 depicts an example environment that includes a multi-carriage vehicle.

FIG. 1 depicts an example environment 100. The environment 100 may be a waiting area, e.g., a subway station, a train depot, or a tram terminal, where a multi-carriage vehicle 150 may arrive for passenger boarding and exiting. Multi-carriage vehicle 150 may be a vehicle, such as a trolley, train, or tram, having multiple passenger carriages 151, 152, 153.

In some implementations, each carriage 151, 152, 153 is equipped with a set of sensors 122. The set of sensors 122 can include, for example, one or more of: image sensors, (e.g., still cameras or video cameras), millimeter-wave (mmWave) sensors, ultra-wide band (UWB) sensors, thermal sensors, pressure sensors, optical sensors, seat occupant sensors, carriage weight sensors, motion sensors, or other types of sensors. The set of sensors 122 can be placed at various locations within each carriage 151, 152, 153, e.g., mounted on a stationary or fixed surface, e.g., a ceiling, a wall, or a floor, within the carriage, among other locations. Each sensor is configured to obtain corresponding sensor measurements within the multi-carriage vehicle 150, e.g., sensor measurements from which information indicative of occupancy of the carriages 151, 152, 153 of the multi-carriage vehicle 150 can be derived.

In some implementations, the set of sensors 122 include vision sensors. Examples of vision sensors include for example, still or video cameras, that can be mounted within the carriage. Each image sensor is configured to obtain sensor measurements that include image and/or video data about the sets of passengers that are onboard each carriage, e.g., a set of passengers 120 onboard the carriage 153.

In some implementations, the set of sensors 122 include one or more millimeter-wave (mmWave) sensors that can be positioned or fastened to the carriage. Each mmWave sensor is configured to obtain sensor measurements that include mmWave data. Specifically, the mm Wave sensor transmits one or more mmWave beams via the one or more antennas and receive one or more reflected mm Wave beams via the one or more antennas. The one or more mmWave beams may be reflected off of a passenger, e.g., one of the set of passengers 120 onboard the carriage 153.

In some implementations, the set of sensors 122 include one or more ultra-wide band (UWB) sensors that can be positioned or fastened to the carriage. Each UWB sensor is configured to obtain sensor measurements that include UWB signals. In some cases, the UWB signals include UWB signals that are transmitted by a UWB tag included in a smart train ticket located within the multi-carriage vehicle 150 and that are captured by the UWB sensor. Once the smart train ticket comes into a predetermined range of the UWB sensor, the UWB signals transmitted by the ticket can be captured by the UWB sensors.

In some cases, the UWB signals include UWB signals that are transmitted by a device that is equipped with an UWB transmitter, such as a smartphone, wristband, or smart key. Analogously, once the device comes into the predetermined range of the UWB sensor, the UWB signals transmitted by the device can be captured by the UWB sensors.

In some implementations, the set of sensors 122 include one or more thermal sensors that can be positioned or fastened to the carriage. Each thermal sensor is configured to obtain sensor measurements that include temperature data at the location of the thermal sensor, e.g., within the carriage 153. Examples of thermal sensors include thermometers, infrared (IR) sensors, semiconductor thermal sensors, or any other device capable of generating sensor data from which the temperature at the location of the thermal sensor can be determined.

In some implementations, the set of sensors 122 include one or more pressure sensors. Each pressure sensor is configured to obtain sensor measurements that include pressure data indicative of an amount of pressure being exerted on the pressure sensor by an external mechanical force, e.g., at least partially because of a weight of a passenger, e.g., the weight of one of the set of passengers 120 onboard the carriage 153.

In some implementations, the set of sensors 122 include one or more optical sensors. Examples of optical sensors include ultrasonic sensors, photodiodes, phototransistors, and light-dependent resistors. Each optical sensor is configured to obtain sensor measurements that include one or more of the following data: temperature data, velocity data, acceleration data, or pose (location and/or orientation) data of a passenger, e.g., one of the set of passengers 120 onboard the carriage 153, or another object.

In some implementations, the set of sensors 122 include one or more motion sensors. Each motion sensor is configured to obtain sensor measurements that include motion data that characterizes a motion of a passenger (or portion thereof), e.g., one of the set of passengers 120 onboard the carriage 153, or another object.

These foregoing examples are not exhaustive, and other types of sensors that are capable of capturing information indicative of occupancy of a carriage can additionally or alternatively be used.

In some implementations, the multi-carriage vehicle 150 is equipped with one or more computing devices 124. In these implementations, the set of sensors 122 can be connected via a wired and/or wireless connection to the one or more computing devices 124, and the one or more computing devices 124 can be configured to analyze and/or process data transmitted by the set of sensors 122. For example, each of the set of sensors 122 can continuously transmits sensor measurements that are captured in real-time by the sensor to the one or more computing devices 124 via the wired and/or wireless connection. As used herein, "real-time" means within a predetermined time period of new sensor measurements being obtained, e.g., within seconds, or milliseconds, or shorter.

Furthermore, the one or more computing devices 124 can receive other data, such as passenger itinerary data, from the passengers themselves (e.g., from a wireless communication link with their phones) or from a remote server (e.g., a server that maintains booking information for the multi-carriage vehicle).

The environment 100 includes a structure 160. The structure 160 may be a waiting platform at a next stop where the multi-carriage vehicle 150 is arriving. In some implementations, the structure 160 is equipped with a set of sensors 132. The set of sensors 132 can include, for example, one or more of: image sensors, e.g., still cameras or video cameras, millimeter-wave (mmWave) sensors, ultra-wide band (UWB) sensors, thermal sensors, pressure sensors, optical sensors, seat occupant sensors, carriage weight sensors, motion sensors, or other types of sensors. The set of sensors 132 can placed at various locations within structure 160, e.g., mounted on a stationary or fixed surface, e.g., a ceiling, a wall, or a floor, within the structure 160, among other locations. Each sensor is configured to obtain corresponding sensor measurements within the structure 160, e.g., sensor measurements about a set of passengers 162 that are distributed about the waiting platform.

In some implementations, the structure 160 is equipped with one or more computing devices 134. In these implementations, the set of sensors 132 can be connected via a wired and/or wireless connection to the one or more computing devices 134, and the one or more computing devices 134 can be configured to analyze and/or process data transmitted by the set of sensors 132. For example, each of the set of sensors 132 can continuously transmits sensor measurements that are captured in real-time by the sensor to the one or more computing devices 134 via the wired and/or wireless connection.

The one or more computing devices 134 can receive other data, such as passenger itinerary data, from the passengers themselves (e.g., from a wireless communication link with their phones) or from a remote server (e.g., a server that maintains booking information for the multi-carriage vehicle). Furthermore, the one or more computing devices 134 can be connected via a wireless connection to the set of sensors 122 equipped by the multi-carriage vehicle 150, and the one or more computing devices 134 can be configured to analyze and/or process data transmitted in real-time by the set of sensors 122. The one or more computing devices 134 can also be connected via a wireless connection to the one or more computing devices 124 equipped on the multi-carriage vehicle 150.

As illustrated in FIG. 1, the multi-carriage vehicle 150 is arriving at the waiting platform of the structure 160 for passenger boarding and exiting, where each carriage has an approximate stopping position at the waiting platform, e.g., carriage 151 has an approximate stopping position 141 at the waiting platform. To enable the passengers 162 in the waiting platform to efficiently distribute among the vehicle carriages 151, 152, 153 of the multi-carriage vehicle 150, and to improve the experience for the passengers 162, the environment 100 includes a boarding recommendation system 110.

Figure 2:
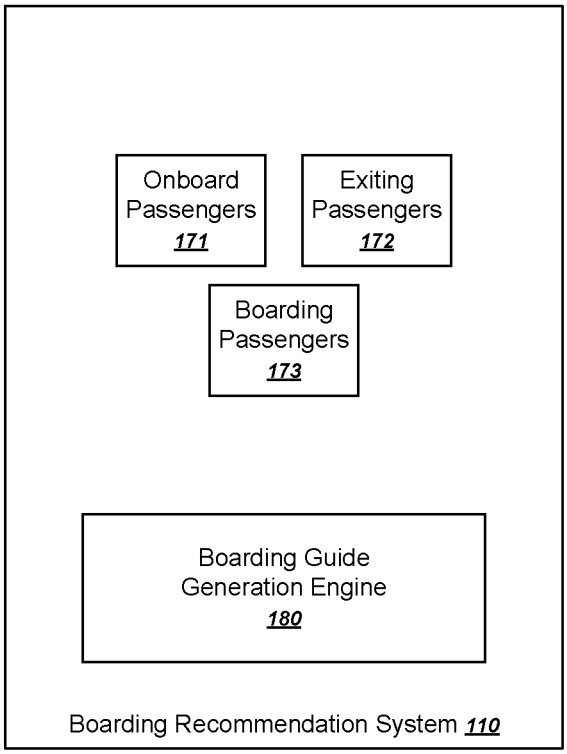
FIG. 2 is a block diagram of an example boarding recommendation system.

FIG. 2 is a block diagram of an example boarding recommendation system 110. The boarding recommendation system 110 is a system implemented as computer programs on one or more computers in one or more locations that generates and presents boarding guides based on real-time sensor data to assist the passengers 162 with boarding the multi-carriage vehicle 150.

In some implementations, the boarding recommendation system 110 is local to the structure 160 at which the multi-carriage vehicle 150 is arriving. For example, the boarding recommendation system 110 is implemented (at least partially) on the one or more computing devices 134 included in the structure 160.

In these implementations, the processing of the sensor measurements and the generation of boarding guides can take place (at least partially) locally at the structure 160. Processing the sensor measurements locally at the structure 160 reduces the burden on a network that connects the one or more computing devices 134 included in the structure 160 and another system outside of the structure 160. Moreover, since the sensor measurements need not be transmitted to another system, data security of the boarding recommendation system 110 may be improved.

In other implementations, the boarding recommendation system 110 is remote from the structure 160 at which the multi-carriage vehicle 150 is arriving. For example, the boarding recommendation system 110 can be hosted within a data center, which can be a distributed computing system having hundreds or thousands of computers in one or more locations. For example, the sets of sensors 122, 132 can transmit the sensor measurements in real-time via a wired and/or wireless connection to the data center.

In these other implementations, the processing of the sensor measurements can take place remote from the structure 160, and a remote boarding recommendation system that is hosted within a data center with much more computing and other resources than those available within the structure 160 to reduce the latency in processing the sensor measurements to generate boarding guides.

In particular, the boarding recommendation system 110 can process the sensor measurements in real-time to determine information that generally indicates a current passenger distribution of the passengers onboard the multi-carriage vehicle 150. The processing can be done locally at the structure 160 of the multi-carriage vehicle 150 (e.g., by one or more computing devices 134 included in the structure 160), or can alternatively be done remotely from the structure 160, or can be done partially locally at the structure 160 and partially remotely from the structure 160.

For example, the boarding recommendation system 110 can determine information that corresponds to specific carriages of the multi-carriage vehicle 150 of FIG. 1. The information can include a number of passengers onboard a carriage, a predicted available capacity of a carriage (i.e., a predicted capacity of the carriage after passengers have exited the carriage at the next stop, but before and passengers have an opportunity to board the carriage at the next stop), and/or a predicted departure capacity of a carriage (i.e., a predicted capacity of the carriage after passengers have had an opportunity to exit and board the carriage at the next stop).

The information can also include a number of seated or standing passengers onboard a carriage, a density of passengers positioned in a particular portion of the carriage (e.g., near the doors where they would exit at the next stop), and/or a direction of motion of one or more passengers.

The boarding recommendation system 110 maintains, for each carriage 151, 152, 153 of the multi-carriage vehicle 150, an estimated number of onboard passengers 171 (i.e., an estimated number of passengers onboard the carriage), an estimated number of exiting passengers 172 (i.e., an estimated number of passengers who will exit the carriage at the next stop), and an estimated number of boarding passengers 173 (i.e., an estimated number of passengers who will board the carriage at the next stop).

These numbers 171, 172, 173 can then be used by the boarding recommendation system 110 to generate the information that corresponds to specific carriages of the multi-carriage vehicle. For example, the predicted available capacity of a carriage (i.e., a predicted capacity of the carriage after passengers have exited the carriage at the next stop, but before passengers waiting at the platform have an opportunity to board the carriage at the next stop) can be determined by subtracting the estimated number of onboard passengers 171 from a predetermined maximum passenger capacity for the carriage, and adding the estimated number of exiting passengers 172 to the result. Such a predicted available capacity of the carriage may also be viewed as an estimated number of additional passengers the carriage can accommodate once it arrives at the next stop.

As another example, the predicted departure capacity of a carriage (i.e., a predicted capacity of the carriage after passengers have had an opportunity to exit and board the carriage at the next stop) can be determined by subtracting the estimated number of boarding passengers 173 from the predicted available capacity of the carriage for the carriage.

In some implementations, the boarding recommendation system 110 receives sensor measurements obtained by the sets of sensors 122, 132 that are placed within the multi-carriage vehicle 150 and the structure 160, respectively, and processes the received sensor measurements to update one or more of the numbers 171, 172, and 173 in real-time. The manner in which the boarding recommendation system 110 processes the sensor measurements to compute one or more of the numbers 171, 172, and 173 can depend on which sensors are actually included in the sets of sensors 122, 132. In some implementations, the boarding recommendation system 110 uses sensor measurements that include image and/or video data obtained by one or more image sensors to compute the estimated number of onboard passengers 171 for each carriage of the multi-carriage vehicle 150. For example, the boarding recommendation system 110 can determine the estimated number of onboard passengers 171 based on using one or more machine learning models, e.g., a convolutional neural network or another type of neural network, to perform object detection or image segmentation on images that depict a space within the carriage that includes the passengers.

The boarding recommendation system 110 can be configured to use various techniques to determine the number of passengers in a carriage. For example, the boarding recommendation system 110 can use object detection techniques to identify individual passengers in the space within the carriage and determine the number of individual passengers. As another example, the boarding recommendation system 110 can use instance segmentation techniques or other segmentation techniques such as semantic segmentation techniques to identify the pixel boundaries of each of the individual passengers in the space within the carriage and determine the number of individual passengers.

In some implementations, the boarding recommendation system 110 uses sensor measurements that include mmWave data obtained by one or more mmWave sensors to compute the estimated number of onboard passengers 171 for each carriage of the multi-carriage vehicle 150. For example, the boarding recommendation system 110 can compare the mmWave data to a threshold to determine if a passenger is detected. For example, the received signal strength of the one or more reflected mm Wave beams is compared to a threshold to determine if a passenger is detected. The higher the signal strength, the more likely the passenger is present in the carriage.

In some implementations, the boarding recommendation system 110 uses sensor measurements that include UWB data obtained by one or more UWB sensors to compute the estimated number of onboard passengers 171 for each carriage of the multi-carriage vehicle 150. For example, the boarding recommendation system 110 can use the UWB data to identify how many smart train tickets (that each include a UWB tag), or how many UWB-enabled device (e.g., a mobile phone or a tablet computer), are present in the carriage.

In some implementations, the boarding recommendation system 110 uses sensor measurements that include temperature data obtained by one or more thermal sensors to compute the estimated number of onboard passengers 171 for each carriage of the multi-carriage vehicle 150. For example, the boarding recommendation system 110 can use a value of the ambient temperature of the carriage to estimate the number of onboard passengers in the carriage. Intuitively, the value of the ambient temperature grows as the number of onboard passengers increases. This makes sense, because as more passengers are present in the carriage, the body temperature of each of the passengers will raise the ambient temperature of the carriage.

In some implementations, the boarding recommendation system 110 use sensor measurements that include pressure (or weight) data obtained by one or more pressure sensors and/or one or more weight sensors to compute the estimated number of onboard passengers 171 for each carriage of the multi-carriage vehicle 150. For example, the boarding recommendation system 110 can use a value of the pressure (or weight) of the carriage to estimate the number of onboard passengers in the carriage. A larger number of passengers being present in the carriage will result in a weight increase of the carriage. The weight increase can be measured in the carriage by way of pressure sensors or weight sensors installed in the floor, and a number of passengers can be estimated under the assumption of average weights of a passenger (e.g., with or without luggage).

In some implementations, the boarding recommendation system 110 uses sensor measurements that include optical data obtained by one or more optical sensors to compute the estimated number of onboard passengers 171 for each carriage of the multi-carriage vehicle 150. For example, the optical sensor can be installed near each carriage door, e.g., with a light emitter on one side and a light detector on the other side, and the boarding recommendation system 110 use the optical data can count the boarding of passengers into each carriage, e.g., based on the number of times a light path formed between the pair of light emitter and light detector is blocked. Sensor measurements obtained by other sensors, e.g., seat occupant sensors, motion sensors, and so on, can also be used to determine the number of individual passengers in the carriage.

In some implementations, the sensor measurements obtained by one sensor can be synthesized with the sensor measurements obtained by another sensor to aid in determining how many passengers are onboard the carriage, e.g., to improve the accuracy of the estimation of the number of onboard passengers 171. For example, mmWave beams and/or UWB signals can be used to validate or otherwise confirm the presence of one or more particular individual passengers, e.g., in the cases where they are obstructed by other passengers in the field-of-view of a camera sensor. In some implementations, velocity data, acceleration data, and/or pose (location and/or orientation) data derived from the sensor measurements captured by the optical sensors, motion data captured by motion sensors, or both can be used to validate or otherwise confirm the presence of one or more particular individual passengers, e.g., in the cases where they are a large number of passengers in the field-of-view of a camera sensor.

In some implementations, an initial, low-complexity process can be used prior to invoking a relatively more complex process on an as-needed basis. For example, a low complexity sensor such as a thermal sensor can be first used to detect that the carriage is occupied by at least one passenger, and in response a more complex process can be invoked to determine occupancy accurately. For example, in response to detecting that a carriage is occupied by at least one passenger, a relatively more complex sensor such as a camera can be used to capture image data of the carriage, which in turn can be processed using one of the image processing techniques described above to determine the estimated number of onboard passengers 171. The threshold for invoking the more complex process can be variable. For example, instead of detecting whether a carriage is occupied by a single passenger, the more complex process can be invoked when the thermal sensor (or another low-complexity sensor) indicates the occupancy to be above another threshold.

In some implementations, the boarding recommendation system 110 uses techniques similar to some of those described above to determine the estimated number of exiting passengers 172 (i.e., an estimated number of passengers who will exit the carriage at the next stop). For example, the boarding recommendation system 110 can process the image and/or video data obtained by one or more image sensors placed within a carriage using one or more machine learning models or other image analysis algorithms to predict a number of passengers onboard the carriage who are likely to exit at the next stop. For example, the boarding recommendation system 110 can analyze a set of images to determine a number of passengers in an area that indicates they may be preparing to get off the multi-carriage vehicle (e.g., near the door) and/or to determine a number of passengers moving towards the doors (e.g., by analysis of video).

In some implementations, the boarding recommendation system 110 uses other data to aid in determining the estimated number of exiting passengers 172. For example, the other data can include passenger itinerary data obtained from a remote server (e.g., a server that maintains itinerary information for the passengers onboard the carriage). As another example, the other data can include UWB signals (transmitted by the UWB tags included in the smart train tickets) that can aid the boarding recommendation system 110 in determining the estimated number of exiting passengers 172. As another example, the other data can include historical data on what percentage of passengers were expected to exit the multi-carriage vehicle 150 at the next stop.

In some implementations, the boarding recommendation system 110 uses techniques similar to some of those described above to determine the estimated number of boarding passengers 173 (i.e., an estimated number of passengers who will board the carriage at the next stop. When those techniques are applied on sensor data obtained by the set of sensors placed at various locations within the structure 160, the boarding recommendation system 110 can determine the estimated number of boarding passengers 173 (i.e., an estimated number of passengers who will board the carriage at the next stop), and other information pertaining to the passengers waiting at the platform, such as the direction of motion of the passengers waiting at the platform.

In some implementations, the estimated numbers of onboard passengers 171, the estimated numbers of exiting passengers 172, and the estimated numbers of boarding passengers 173, can be used by a boarding guide generation engine 180 to update the boarding guides (potentially in real-time) to assist passengers with boarding a multi-carriage vehicle 150.

In some implementations, the boarding guide generation engine 180 can implement a trained machine learning model or some other software modules that is configured to output a boarding recommendation scheme for multi-carriage vehicles based on one or more of these numbers and/or other information such as time of the day, time until next train, expected crowd data, and so on.

Referring back to FIG. 1, boarding guides in the form of visual representations 144, 146 can be used to guide the set of passengers 162 to different boarding locations. The visual representations 144, 146 include information that corresponds to specific carriages of the multi-carriage vehicle 150. In some implementations, each carriage 151, 152, 153 has a distinct, corresponding visual representation that can be displayed approximately adjacent to a corresponding, approximate stopping position 141, 142, 143, respectively. For example, as illustrated in FIG. 1, carriage 151 has a corresponding visual representation 144, while carriage 152 has a corresponding visual representation 146, which can take the same or different form than the visual representations 144. In the example of FIG. 1, the visual representation 144 is presented on a public display device that is mounted on a surface of (but external to) the structure 160, while the visual representation 146 is presented on a public display device that is integrated into the structure 160. In some implementations, the carriages 151, 152, 153 share one or more common visual representations displayed at a common location.

In some implementations, the visual representation can include information such as a number of passengers onboard a carriage, a predicted available capacity of a carriage (i.e., a predicted capacity of the carriage after passengers have exited the carriage at the next stop, but before and passengers have an opportunity to board the carriage at the next stop), and/or a predicted departure capacity of a carriage (i.e., a predicted capacity of the carriage after passengers have had an opportunity to exit and board the carriage at the next stop). The visual representation can include other information, e.g., estimated time of arrival of the multi-carriage vehicle, a number of carriages of the vehicle, and so on.

As illustrated in FIG. 1, a first carriage 151 has an approximate stopping position 141 at the next stop. Adjacent to the stopping position 141, a visual representation 144 includes information corresponding to the first carriage 151, such as a predicted available capacity of a carriage (i.e., a predicted capacity of the carriage after passengers have exited the carriage at the destination, but before and passengers have an opportunity to board the carriage at the next stop). Likewise, a second carriage 152 has an approximate stopping position 142 at the next stop. Adjacent to the stopping position 142, a visual representation 146 includes information corresponding to the second carriage 152.

This configuration permits the set of passengers 162 waiting to board the multi-carriage vehicle 150 to self-distribute accordingly. For example, the visual representation 144, 146 may be updated to encourage the set of passengers 162 queued for boarding the multi-carriage vehicle 150 to walk to the approximate stopping position corresponding to a carriage that has a larger amount of predicted available capacity. As another example, the visual representation 144, 146 may be updated to encourage the set of passengers 162 queued for boarding the multi-carriage vehicle 150 to walk away from the approximate stopping position corresponding to a carriage that has a lower amount of predicted available capacity, thereby avoiding a crowded transition between passengers exiting a carriage at the next stop and passengers boarding the carriage at the next stop. As yet another example, even if an approaching carriage is relatively empty, if the number of passengers lined up to get on that carriage exceeds the predicted available capacity of the carriage, the visual representation may be updated to encourage additional passengers to move towards another carriage.

The visual representations 144, 146 can take one or more forms, including for example, a set of colors or patterns, a set of images, a set of alphanumeric characters, and/or a set of audio sounds. Additionally, the visual representations may be displayed in a variety of ways. For example, a visual representation, e.g., the visual representation 144, can be presented on a public display device that is mounted on (but external to) the structure 160. Examples of such a display device include a television device, a digital signage, a PID (Public Information Display), and so on.

In some implementations, the visual representation 146, can be presented on a public display device that is integrated into the structure 160. Such a display device can be disposed, for example, on a surface of the structure 160; when presented on the image plane, the visual representation may appear as if it is a part of the surface of the structure 160 at some distance away from the display device.

As another example, a visual representation can be presented on a mobile computing device, e.g., a smartphone, a tablet, a smartwatch, and so on. For example, the mobile computing device can execute an application that receives information from the boarding recommendation system 110, obtains the location information from the mobile computing device, and assigns an optimal, personalized boarding location (e.g., nearest carriage with a threshold capacity available). In this example, passengers can access this information on their smartphones even before they arrive at the station. This could help them not only to select the carriage but also to know at what time they can board the vehicle.

As another example, a visual representation can be a projection onto a surface within the structure 160 (e.g., a projection onto a surface of the waiting platform).

As another example, a visual representation can include an illuminated section of the structure 160, e.g., an illuminated section of a floor, wall, and/or ceiling. For example, the visual representation can include illuminating (e.g., by projection, embedded lights, etc.) a set of doors that block off access to the tracks when the multi-carriage vehicle is not in the station, such as the doors that are commonly found in airports or subways.

In some implementations, boarding guides in the form of audio representations that include the information that corresponds to specific carriages of the multi-carriage vehicle 150 are audible to the set of passengers 162. For example, the audio representations can be played on audio display device, e.g., a loudspeaker or a public address system, within the structure 160.

Figure 3:
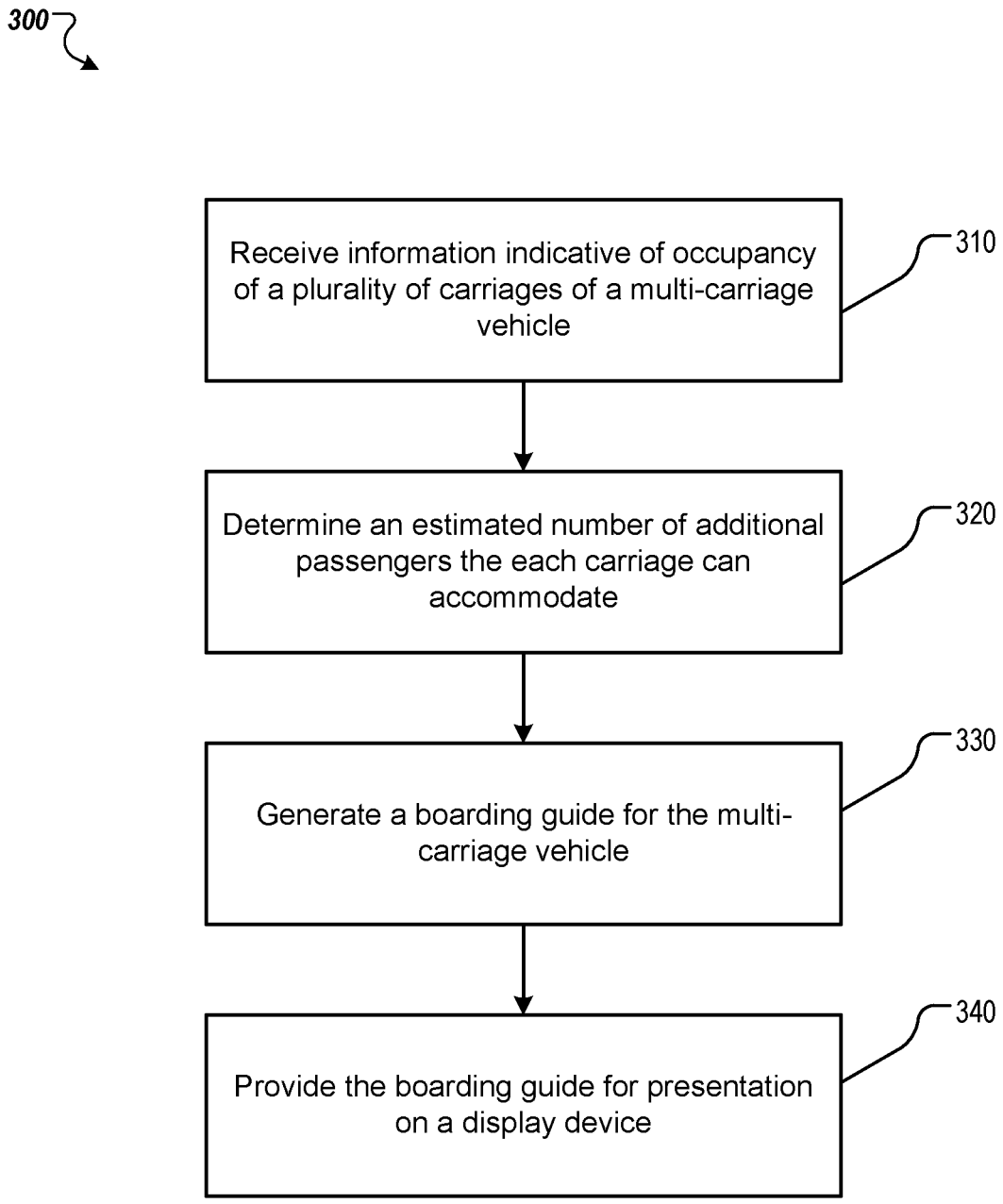
FIG. 3 is a flow diagram of an example process for generating and providing a boarding guide for presentation.

FIG. 3 is a flow diagram of an example process 300 for generating and providing a boarding guide. For convenience, the process 300 will be described as being performed by a system of one or more computers, located in one or more locations, and programmed appropriately in accordance with this specification. For example, a boarding recommendation system, e.g., the boarding recommendation system 110 of FIG. 1, appropriately programmed, can perform the process 300.

The system receives information indicative of occupancy of a plurality of carriages of a multi-carriage vehicle (step 310). Specifically, the system receives sensor measurements captured by a set of sensors deployed within the multi-carriage vehicle, and processes the sensor measurements to generate the information indicative of occupancy of the plurality of carriages of the multi-carriage vehicle.

For example, the set of sensors include two or more of: an image sensor, e.g., a still cameras or video camera, a millimeter-wave (mmWave) sensor, an ultra-wide band (UWB) sensor, a thermal sensor, a pressure sensor, or an optical sensor.

The system determines, for each of the plurality of carriages, an estimated number of additional passengers the corresponding carriage can accommodate (step 320). The estimated number of additional passengers, namely the predicted available capacity of a carriage (i.e., a predicted capacity of the carriage after passengers have exited the carriage at the next stop, but before passengers waiting at the platform have an opportunity to board the carriage at the next stop), can be determined by the system based on processing the received information.

In some implementations, the system maintains, for each of the plurality of carriages, an estimated number of onboard passengers that is determined based on processing the sensor measurements, e.g., using some of the techniques described above. For each of the plurality of carriages, the system also maintains an estimated number of exiting passengers that is determined based on processing the sensor measurements, e.g., using some of the techniques described above.

In these implementations, for each of the plurality of carriages, the estimated number of additional passengers the corresponding carriage can accommodate can then be determined by subtracting the estimated number of onboard passengers from a predetermined maximum passenger capacity for the carriage, and adding the estimated number of exiting passengers to the result.

The system generates, based on the corresponding estimated numbers of additional passengers for each of the plurality of carriages, a boarding guide for the multi-carriage vehicle (step 330). For example, the boarding guide can take the form of a visual representation that is viewable to the passengers waiting at the platform. As another example, the boarding guide can take the form of an audio representation that is audible to the passengers waiting at the platform. As yet another example, the boarding guide can take the form of both a visual representation and an audio representation.

The system provides the boarding guide for presentation on a display device configured to assist with boarding passengers on the multi-carriage vehicle (step 340). For example, the display device can be a display device located in a platform at the next stop where the multi-carriage vehicle is arriving for passenger boarding and exiting. As another example, the display device can be a display device of a mobile computing device of one of the passengers waiting at the next stop. As yet another example, the display device can be an audio display device located at the next stop.

A number of implementations have been described. Nevertheless, it will be understood that various modifications may be made without departing from the spirit and scope of the disclosure. For example, various forms of the flows shown above may be used, with steps re-ordered, added, or removed.

Figure 4:
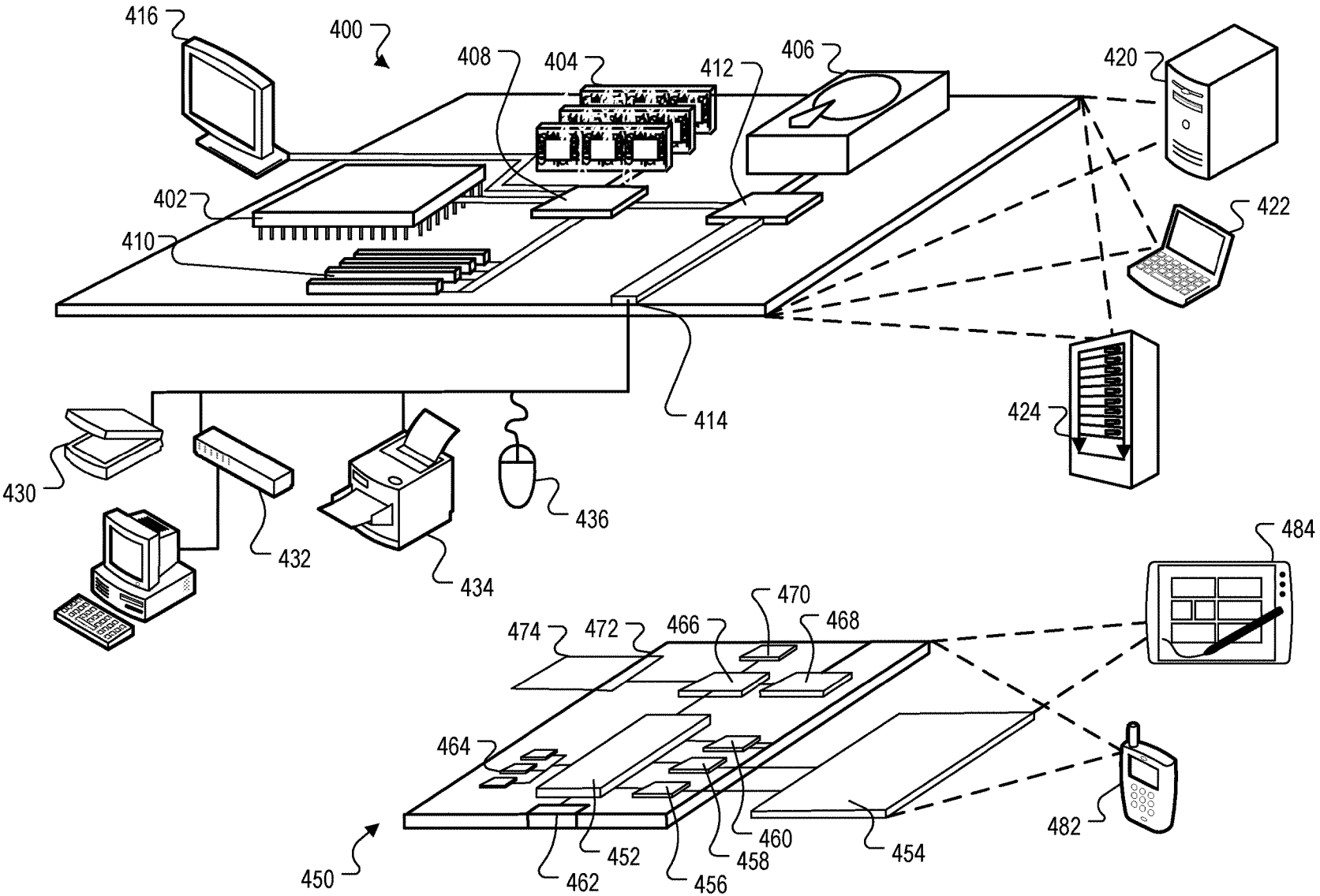
FIG. 4 is a block diagram of a computing system that can be used in connection with computer-implemented methods described in this specification.

FIG. 4 shows an example of a computing device 400 and a mobile computing device 450 that are employed to execute implementations of the present disclosure. The computing device 400 is intended to represent various forms of digital computers, such as laptops, desktops, workstations, personal digital assistants, servers, blade servers, mainframes, and other appropriate computers. The mobile computing device 450 is intended to represent various forms of mobile devices, such as personal digital assistants, cellular telephones, smart-phones, AR devices, and other similar computing devices. The components shown here, their connections and relationships, and their functions, are meant to be examples only, and are not meant to be limiting. The computing device 400 and/or the mobile computing device 450 can form at least a portion of the application installation environment described above.

The computing device 400 includes a processor 402, a memory 404, a storage device 406, a high-speed interface 408, and a low-speed interface 412. In some implementations, the high-speed interface 408 connects to the memory 404 and multiple high-speed expansion ports 410. In some implementations, the low-speed interface 412 connects to a low-speed expansion port 414 and the storage device 404. Each of the processor 402, the memory 404, the storage device 406, the high-speed interface 408, the high-speed expansion ports 410, and the low-speed interface 412, are interconnected using various buses, and may be mounted on a common motherboard or in other manners as appropriate. The processor 402 can process instructions for execution within the computing device 400, including instructions stored in the memory 404 and/or on the storage device 406 to display graphical information for a graphical user interface (GUI) on an external input/output device, such as a display 416 coupled to the high-speed interface 408. In other implementations, multiple processors and/or multiple buses may be used, as appropriate, along with multiple memories and types of memory. In addition, multiple computing devices may be connected, with each device providing portions of the necessary operations (e.g., as a server bank, a group of blade servers, or a multi-processor system).

The memory 404 stores information within the computing device 400. In some implementations, the memory 404 is a volatile memory unit or units. In some implementations, the memory 404 is a non-volatile memory unit or units. The memory 404 may also be another form of a computer-readable medium, such as a magnetic or optical disk.

The storage device 406 is capable of providing mass storage for the computing device 400. In some implementations, the storage device 406 may be or include a computer-readable medium, such as a floppy disk device, a hard disk device, an optical disk device, a tape device, a flash memory, or other similar solid-state memory device, or an array of devices, including devices in a storage area network or other configurations. Instructions can be stored in an information carrier. The instructions, when executed by one or more processing devices, such as processor 402, perform one or more methods, such as those described above. The instructions can also be stored by one or more storage devices, such as computer-readable or machine-readable mediums, such as the memory 404, the storage device 406, or memory on the processor 402.

The high-speed interface 408 manages bandwidth-intensive operations for the computing device 400, while the low-speed interface 412 manages lower bandwidth-intensive operations. Such allocation of functions is an example only. In some implementations, the high-speed interface 408 is coupled to the memory 404, the display 416 (e.g., through a graphics processor or accelerator), and to the high-speed expansion ports 410, which may accept various expansion cards. In the implementation, the low-speed interface 412 is coupled to the storage device 406 and the low-speed expansion port 414. The low-speed expansion port 414, which may include various communication ports (e.g., Universal Serial Bus (USB), Bluetooth, Ethernet, wireless Ethernet) may be coupled to one or more input/output devices. Such input/output devices may include a scanner, a printing device, or a keyboard or mouse. The input/output devices may also be coupled to the low-speed expansion port 414 through a network adapter. Such network input/output devices may include, for example, a switch or router.

The computing device 400 may be implemented in a number of different forms, as shown in the FIG. 4. For example, it may be implemented as a standard server 420, or multiple times in a group of such servers. In addition, it may be implemented in a personal computer such as a laptop computer 422. It may also be implemented as part of a rack server system 424. Alternatively, components from the computing device 400 may be combined with other components in a mobile device, such as a mobile computing device 450. Each of such devices may contain one or more of the computing device 400 and the mobile computing device 450, and an entire system may be made up of multiple computing devices communicating with each other.

The mobile computing device 450 includes a processor 452; a memory 464; an input/output device, such as a display 454; a communication interface 466; and a transceiver 468; among other components. The mobile computing device 450 may also be provided with a storage device, such as a micro-drive or other device, to provide additional storage. Each of the processor 452, the memory 464, the display 454, the communication interface 466, and the transceiver 468, are interconnected using various buses, and several of the components may be mounted on a common motherboard or in other manners as appropriate. In some implementations, the mobile computing device 450 may include a camera device(s) (not shown).

The processor 452 can execute instructions within the mobile computing device 450, including instructions stored in the memory 464. The processor 452 may be implemented as a chipset of chips that include separate and multiple analog and digital processors. For example, the processor 452 may be a Complex Instruction Set Computers (CISC) processor, a Reduced Instruction Set Computer (RISC) processor, or a Minimal Instruction Set Computer (MISC) processor. The processor 452 may provide, for example, for coordination of the other components of the mobile computing device 450, such as control of user interfaces (UIs), applications run by the mobile computing device 450, and/or wireless communication by the mobile computing device 450.

The processor 452 may communicate with a user through a control interface 458 and a display interface 456 coupled to the display 454. The display 454 may be, for example, a Thin-Film-Transistor Liquid Crystal Display (TFT) display, an Organic Light Emitting Diode (OLED) display, or other appropriate display technology. The display interface 456 may include appropriate circuitry for driving the display 454 to present graphical and other information to a user. The control interface 458 may receive commands from a user and convert them for submission to the processor 452. In addition, an external interface 462 may provide communication with the processor 452, so as to enable near area communication of the mobile computing device 450 with other devices. The external interface 462 may provide, for example, for wired communication in some implementations, or for wireless communication in other implementations, and multiple interfaces may also be used.

The memory 464 stores information within the mobile computing device 450. The memory 464 can be implemented as one or more of a computer-readable medium or media, a volatile memory unit or units, or a non-volatile memory unit or units. An expansion memory 474 may also be provided and connected to the mobile computing device 450 through an expansion interface 472, which may include, for example, a Single in Line Memory Module (SIMM) card interface. The expansion memory 474 may provide extra storage space for the mobile computing device 450, or may also store applications or other information for the mobile computing device 450. Specifically, the expansion memory 474 may include instructions to carry out or supplement the processes described above, and may include secure information also. Thus, for example, the expansion memory 474 may be provided as a security module for the mobile computing device 450, and may be programmed with instructions that permit secure use of the mobile computing device 450. In addition, secure applications may be provided via the SIMM cards, along with additional information, such as placing identifying information on the SIMM card in a non-hackable manner.

The memory may include, for example, flash memory and/or non-volatile random access memory (NVRAM), as discussed below. In some implementations, instructions are stored in an information carrier. The instructions, when executed by one or more processing devices, such as processor 452, perform one or more methods, such as those described above. The instructions can also be stored by one or more storage devices, such as one or more computer-readable or machine-readable mediums, such as the memory 464, the expansion memory 474, or memory on the processor 452. In some implementations, the instructions can be received in a propagated signal, such as, over the transceiver 468 or the external interface 462.

The mobile computing device 450 may communicate wirelessly through the communication interface 466, which may include digital signal processing circuitry where necessary. The communication interface 466 may provide for communications under various modes or protocols, such as Global System for Mobile communications (GSM) voice calls, Short Message Service (SMS), Enhanced Messaging Service (EMS), Multimedia Messaging Service (MMS) messaging, code division multiple access (CDMA), time division multiple access (TDMA), Personal Digital Cellular (PDC), Wideband Code Division Multiple Access (WCDMA), CDMA2000, General Packet Radio Service (GPRS). Such communication may occur, for example, through the transceiver 468 using a radio frequency. In addition, short-range communication, such as using a Bluetooth or Wi-Fi, may occur. In addition, a Global Positioning System (GPS) receiver module 470 may provide additional navigation- and location-related wireless data to the mobile computing device 450, which may be used as appropriate by applications running on the mobile computing device 450.

The mobile computing device 450 may also communicate audibly using an audio codec 460, which may receive spoken information from a user and convert it to usable digital information. The audio codec 460 may likewise generate audible sound for a user, such as through a speaker, e.g., in a handset of the mobile computing device 450. Such sound may include sound from voice telephone calls, may include recorded sound (e.g., voice messages, music files, etc.) and may also include sound generated by applications operating on the mobile computing device 450.

The mobile computing device 450 may be implemented in a number of different forms, as shown in FIG. 4. For example, it may be implemented as a phone device 482 or a tablet device 484. The mobile computing device 450 may also be implemented as a component of a smart-phone, personal digital assistant, AR device, or other similar mobile device.

Computing device 400 and/or 450 can also include USB flash drives. The USB flash drives may store operating systems and other applications. The USB flash drives can include input/output components, such as a wireless transmitter or USB connector that may be inserted into a USB port of another computing device.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the invention have been described. Other embodiments are within the scope of the following claims. For example, the steps recited in the claims, described in the specification, or depicted in the figures can be performed in a different order and still achieve desirable results. In some cases, multitasking and parallel processing may be advantageous.

What is claimed is:

1. A method comprising:

receiving, at one or more computing devices, information indicative of occupancy of a plurality of carriages of a multi-carriage vehicle, wherein the information is based on data captured using one or more sensors deployed within the multi-carriage vehicle;

for each of the plurality of carriages, determining, based on processing the received information, an estimated number of additional passengers the corresponding carriage can accommodate;

obtaining location information of a passenger from a mobile computing device of the passenger;

generating, based on the corresponding estimated numbers of additional passengers for each of the plurality of carriages and the location information of the passenger, a boarding guide that comprises a personalized boarding location for the passenger for boarding the multi-carriage vehicle; and providing the boarding guide for presentation on a display device of the mobile computing device configured to assist with boarding the passenger on the multi-carriage vehicle.

2. The method of claim 1, wherein the one or more sensors deployed within the multi-carriage vehicle comprise one or more of: a millimeter-wave (mmWave) sensor, an ultra-wide band (UWB) sensor, a thermal sensor, a pressure sensor, or an optical sensor.

3. The method of claim 1, wherein the one or more sensors deployed within the multi-carriage vehicle comprise one or more image sensors.

4. The method of claim 1, wherein determining the estimated number of additional passengers the corresponding carriage can accommodate comprises:

determining an estimated number of onboard passengers who will exit the carriage at a next stop of the multi-carriage vehicle.

5. The method of claim 1, wherein the display device comprises a visual display device of the mobile computing device.

6. The method of claim 1, wherein the display device comprises an audio display device of the mobile computing device.

7. A system comprising:

one or more processors; and one or more non-transitory storage devices storing instructions that are operable, when executed by the one or more processors, to cause the one or more processors to perform operations comprising:

receiving, at one or more computing devices, information indicative of occupancy of a plurality of carriages of a multi-carriage vehicle, wherein the information is based on data captured using one or more sensors deployed within the multi-carriage vehicle;

for each of the plurality of carriages, determining, based on processing the received information, an estimated number of additional passengers the corresponding carriage can accommodate;

obtaining location information of a passenger from a mobile computing device of the passenger;

generating, based on the corresponding estimated numbers of additional passengers for each of the plurality of carriages and the location information of the passenger, a boarding guide that comprises a personalized boarding location for the passenger for boarding the multi-carriage vehicle; and providing the boarding guide for presentation on a display device of the mobile computing device configured to assist with boarding the passenger on the multi-carriage vehicle.

8. The system of claim 7, wherein the one or more sensors deployed within the multi-carriage vehicle comprise one or more of: a millimeter-wave (mmWave) sensor, an ultra-wide band (UWB) sensor, a thermal sensor, a pressure sensor, or an optical sensor.

9. The system of claim 7, wherein the one or more sensors deployed within the multi-carriage vehicle comprise one or more image sensors.

10. The system of claim 7, wherein determining the estimated number of additional passengers the corresponding carriage can accommodate comprises:

determining an estimated number of onboard passengers who will exit the carriage at a next stop.

11. The system of claim 7, wherein the display device comprises a visual display device of the mobile computing device.

12. The system of claim 7, wherein the display device comprises an audio display device of the mobile computing device.

13. One or more non-transitory computer storage media encoded with computer program instructions that when executed by one or more computers cause the one or more computers to perform operations comprising:

receiving, at one or more computing devices, information indicative of occupancy of a plurality of carriages of a multi-carriage vehicle, wherein the information is based on data captured using one or more sensors deployed within the multi-carriage vehicle;

for each of the plurality of carriages, determining, based on processing the received information, an estimated number of additional passengers the corresponding carriage can accommodate;

obtaining location information of a passenger from a mobile computing device of the passenger;

generating, based on the corresponding estimated numbers of additional passengers for each of the plurality of carriages and the location information of the passenger, a boarding guide that comprises a personalized boarding location for the passenger for boarding the multi-carriage vehicle; and providing the boarding guide for presentation on a display device of the mobile computing device configured to assist with boarding the passenger on the multi-carriage vehicle.

14. The computer storage media of claim 13, wherein the one or more sensors deployed within the multi-carriage vehicle comprise one or more of: a millimeter-wave (mmWave) sensor, an ultra-wide band (UWB) sensor, a thermal sensor, a pressure sensor, or an optical sensor.

15. The computer storage media of claim 13, wherein the one or more sensors deployed within the multi-carriage vehicle comprise one or more image sensors.

16. The computer storage media of claim 13, wherein determining the estimated number of additional passengers the corresponding carriage can accommodate comprises:

determining an estimated number of onboard passengers who will exit the carriage at a next stop.

17. The computer storage media of claim 13, wherein the display device comprises one or both of: a visual display device of the mobile computing device, or an audio display device of the mobile computing device.

18. The method of claim 1, wherein determining the estimated number of additional passengers comprises:

executing a first processing step that processes information generated by a first subset of the plurality of sensors to determine whether the carriage is occupied; and in response to determining that the carriage is occupied, executing a second processing step that processes information generated by a second subset of the plurality of sensors to determine a number of passengers located within the carriage.

19. The system of claim 7, wherein determining the estimated number of additional passengers comprises:

executing a first processing step that processes information generated by a first subset of the plurality of sensors to determine whether the carriage is occupied; and in response to determining that the carriage is occupied, executing a second processing step that processes information generated by a second subset of the plurality of sensors to determine a number of passengers located within the carriage.

20. The computer storage media of claim 13, wherein determining the estimated number of additional passengers comprises:

executing a first processing step that processes information generated by a first subset of the plurality of sensors to determine whether the carriage is occupied; and in response to determining that the carriage is occupied, executing a second processing step that processes information generated by a second subset of the plurality of sensors to determine a number of passengers located within the carriage.

* * * * *